United States Patent [19]

Dietrich

[11] 4,416,125

[45] Nov. 22, 1983

[54] FEED DEVICE EQUIPMENT FOR LETTING OUT HIDES

[75] Inventor: Herbert Dietrich, Kaiserslautern, Fed. Rep. of Germany

[73] Assignee: Pfaff Industriemaschinen GmbH, Fed. Rep. of Germany

[21] Appl. No.: 364,898

[22] Filed: Apr. 2, 1982

[30] Foreign Application Priority Data

Apr. 6, 1981 [DE] Fed. Rep. of Germany ..... 3113836

[51] Int. Cl.[3] ..... C14B 15/00; C14B 17/00

[52] U.S. Cl. ..... 69/21; 69/27; 69/47

[58] Field of Search ..... 69/27, 2, 23, 33, 47, 69/21, 22

[56] References Cited

U.S. PATENT DOCUMENTS 2,712,230 7/1955 Schaab et al. ..... 69/27

3,199,320 8/1965 Theil ..... 69/21

*Primary Examiner*—Patrick D. Lawson

*Attorney, Agent, or Firm*—McGlew and Tuttle

[57] ABSTRACT

Equipment for letting out hides, in which the hides are cut several times obliquely to their lateral edges, the hide parts are then laterally offset and then sewn together again. A gripping tool is provided and is movable crosswise and lengthwise to the cutting line. After the sewing operation, the gripping tool seizes the cut edge and pulls the hide crosswise to the cutting line by the desired distance between cuts. Thereafter it moves the hide parallel to the cutting line, to obtain a constant distance between the sewing machine and the respective seam start on the hide.

10 Claims, 13 Drawing Figures

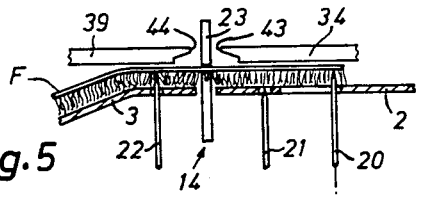
Fig.5
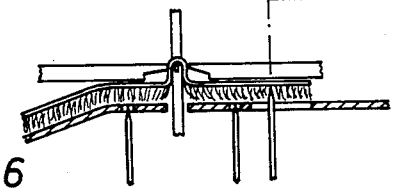
Fig.6
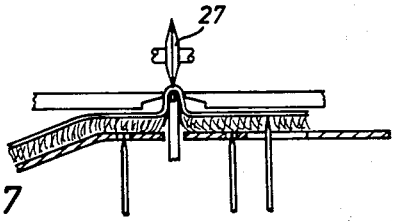
Fig.7
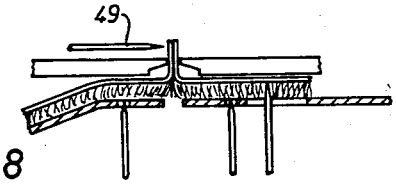
Fig.8
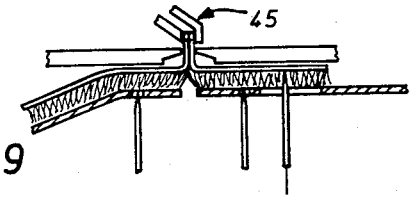
Fig.9
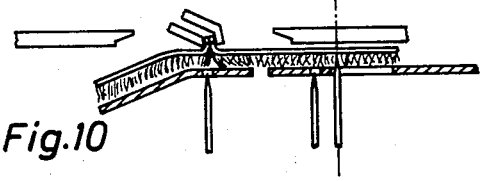
Fig.10
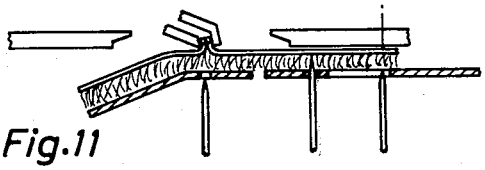
Fig.11
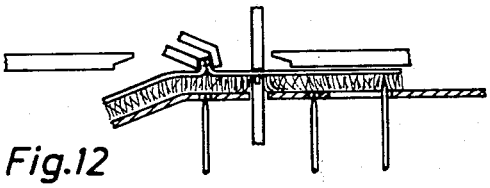
Fig.12
Fig.13
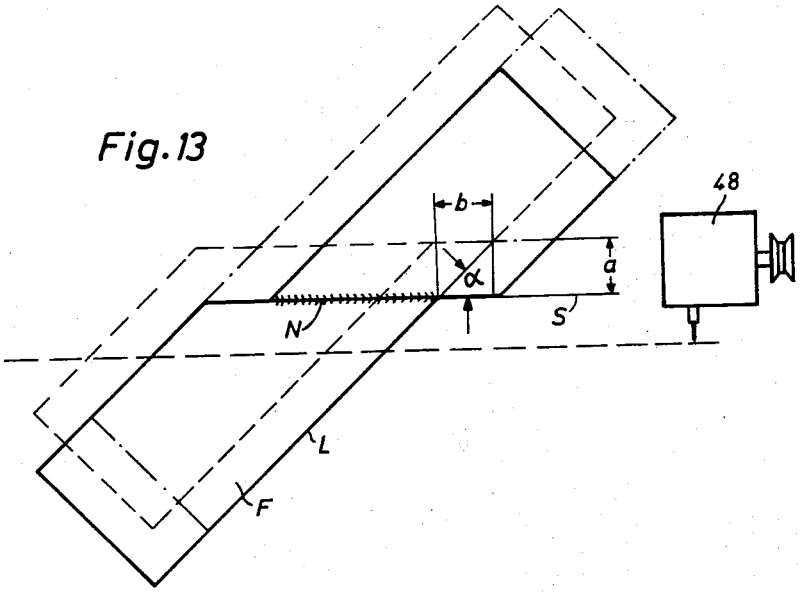

FEED DEVICE EQUIPMENT FOR LETTING OUT HIDES

FIELD AND BACKGROUND OF THE INVENTION

The present invention relates in general to hide processing equipment, and in particular to a new and useful device for letting out hides to be cut and sewn together.

Equipment is known for letting out or feeding hides having a holding device for the hide, to clamping jaws cooperating like pliers and movable relative to each other in a longitudinal direction, a parting sword arranged between the jaws with a forwardly positioned hide hair divider and a cutting and sewing device for cutting the hide and sewing edges of the hide together.

Such a device can be seen from German Pat. No. 22 04 399. The equipment comprises two clamping jaws mounted above a table panel for receiving the hide, which are movable relative to each other in a lengthwise and transverse direction. Between the jaws a longitudinally displaceable parting sword is movable up and down and has a hide hair divider arranged thereon. Above the parting sword, a lowerable cutting device is arranged and laterally of the parting sword a sewing machine is arranged.

When a hide is let out, the hide hair is parted obliquely to its lateral edges to form a parting furrow in the hair, and is then bisected by a cut extending in the parting furrow. Then follows the so-called backspacing, in that one hide part is laterally offset relative to the other. The hide parts are then sewn together again, whereupon the hide is displaced crosswise to the cutting direction for the execution of the next cut. These operations are repeated until the entire hide has been let out.

During the cutting, backspacing and sewing together operations, the hide is held by the two clamping jaws. After the sewing operation, the jaws are moved apart, whereby the hide is stretched and the fold formed after the parting operation, by raising the parting sword, is pulled flat in the cut or seam region. The transverse displacement of the hide that is necessary before execution of the next cutting operation is effected by a corresponding transverse shift of the rear clamping jaw. During this transverse shift the front jaw is lifted off the hide and is moved back in the direction of the parting sword. After a completed transverse shift, the front jaw is again lowered onto the hide and the rear jaw lifted and then likewise moved back in the direction of the parting sword.

In stretching the hide, it may happen that due to the different friction between the clamping jaws and the hide, the hide slips under one of the jaws, so that then the seam is off center or askew between the clamping plates. In that case an exact distance between cuts cannot be achieved during the subsequent transverse shifting of the rear clamping jaw. Additional displacements of the hide may occur due to the two clamping jaws applying at times only alternately on the hide, so that during the time the hide can be moved uncontrolled below the respective lifted clamping jaw. This may happen in particular with hides which are not flat in themselves, but for example tend to roll up in their edge zones.

SUMMARY OF THE INVENTION

It is the object of the present invention to provide equipment which, in letting out hides, makes it possible to execute cuts in the hides which always run parallel and are at exactly maintainable mutual spacings.

Accordingly another object of the invention is to provide a device for letting out a hide to be cut and sewn at seams extending in a longitudinal direction and at an angle to a leading edge of the hide comprising, a pair of clamping jaws for clamping the hide at each seam, a parting sword movable between the jaws and in the longitudinal direction, the sword extending in the longitudinal direction and having a hide hair divider for parting the hair of the hide to form a furrow therein, sword drive means connected to the sword for moving the sword in a longitudinal direction to form the furrow and upwardly to push the hide in the area of each seam between the jaws, cutting means for cutting the hide at each seam, a sewing machine for sewing the hide at each seam and a seam gripper for gripping the seam after it is sewn and for moving the seam downwardly and transversely to the longitudinal direction for repositioning the hide to form a new sewn seam.

By gripping the hide always at the upwardly seam edge with a gripping tool which can be moved up and down as well as crosswise to the parting sword in a horizontal plane, the fold formed in the hide after parting can be flattened and the hide smoothed by simply lowering the gripping tool.

Since on the one hand the hide is firmly clamped between the jaws of the gripping tool and, on the other, the fold is smoothed, not by stretching the hide, but by bringing the gripping tool down, the hide cannot become displaced or pulled askew relative to the gripping tool.

After the lowering step, the gripping tool shifts the hide crosswise to the parting sword and brings it into the position required for the execution of the next cut. As the gripping tool always remains closed during its lowering motion and transverse movement, the hide cannot warp or move in an uncontrolled manner even during the transverse movement. And since it is possible moreover to retain the hide with the gripping tool to the end of the then following next parting process, the hide is moved by the gripping tool always by the desired amount and is securely held, so that exactly parallel cuts can be carried out at exactly constant mutual spacing, any desired number of times.

Since in the letting out of hides the cutting lines extend at an acute angle, called the cutting angle, to the lengthwise edges of the hide, and since the transverse displacement of the hide is at right angles with the cutting lines, the end points of the cutting lines lying at the longitudinal edges of the hide move during each transverse displacement of the hide either away from or toward the sewing machine in its inoperative position, depending on the slant of the hide. The amount of this lateral displacement corresponds to the length of the adjacent sides of the right angle triangle formed by the cutting angle and the distance between cuts. To maintain the distance between the sewing machine, after it has been moved back into the inoperative position after each sewing operation, and the longitudinal edge of the hide toward the sewing machine, constant, according to another proposal of the invention, the gripping tool is moved parallel to the parting sword by the length of the adjacent side of the triangle of the cutting angle and distance between cuts. This lengthwise movement can take place before or after the transverse movement. Preferably, however, the transverse and longitudinal movements of the gripping tool occur simultaneously and the hide is moved parallel to the longitudinal edge facing the sewing machine.

A further advantageous development of the invention, consists in limiting the length of the movement of the gripping tool parallel to the parting sword by an adjustable cam plate, which is provided with a scale representing the cutting angles. This cam plate acts directly as a stop for the gripping tool, where the cam radius correlated with a certain scale value, limits the longitudinal movement of the gripping tool according to the length of the lateral displacement of the hide, which displacement results at the adjusted cutting angle during the transverse movement of the hide. The effect of the distance between cuts on the amount of lateral displacement of the hide can be taken into consideration in that a separate cam plate is provided for each cutting distance or that the strike pieces of the gripping tool cooperating with the cam plate are arranged to be adjustable.

A further object of the invention is to provide a device for letting out hides which is simple in design, rugged in construction and economical to manufacture.

A still further object of the invention is to provide a method of letting out hides which are elongated and have a leading edge which is at an acute angle to a longitudinal direction that is parallel to seams to be cut and sewn in the hide, comprising parting hair of the hide to form a furrow therein, pushing the hide up at the furrow into the space between clamping jaws, to form a seam area in the hide, clamping the seam area, cutting the seam area, sewing the seam area, grasping the sewn seam area and retracting the jaws, moving the seam area downwardly and transversely to the longitudinal direction, to reposition the hide for the preparation of an additional sewn seam.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The invention is explained with reference to an embodiment illustrated in the drawings, in which:

FIGS. 5 to 12 are sectional views showing successive work phases of the invention; and FIG. 13 is a representation of the transverse and longitudinal movement of a hide.

DETAILED DESCRIPTION OF PREFERRED EMBODIMENT

Figure 1:
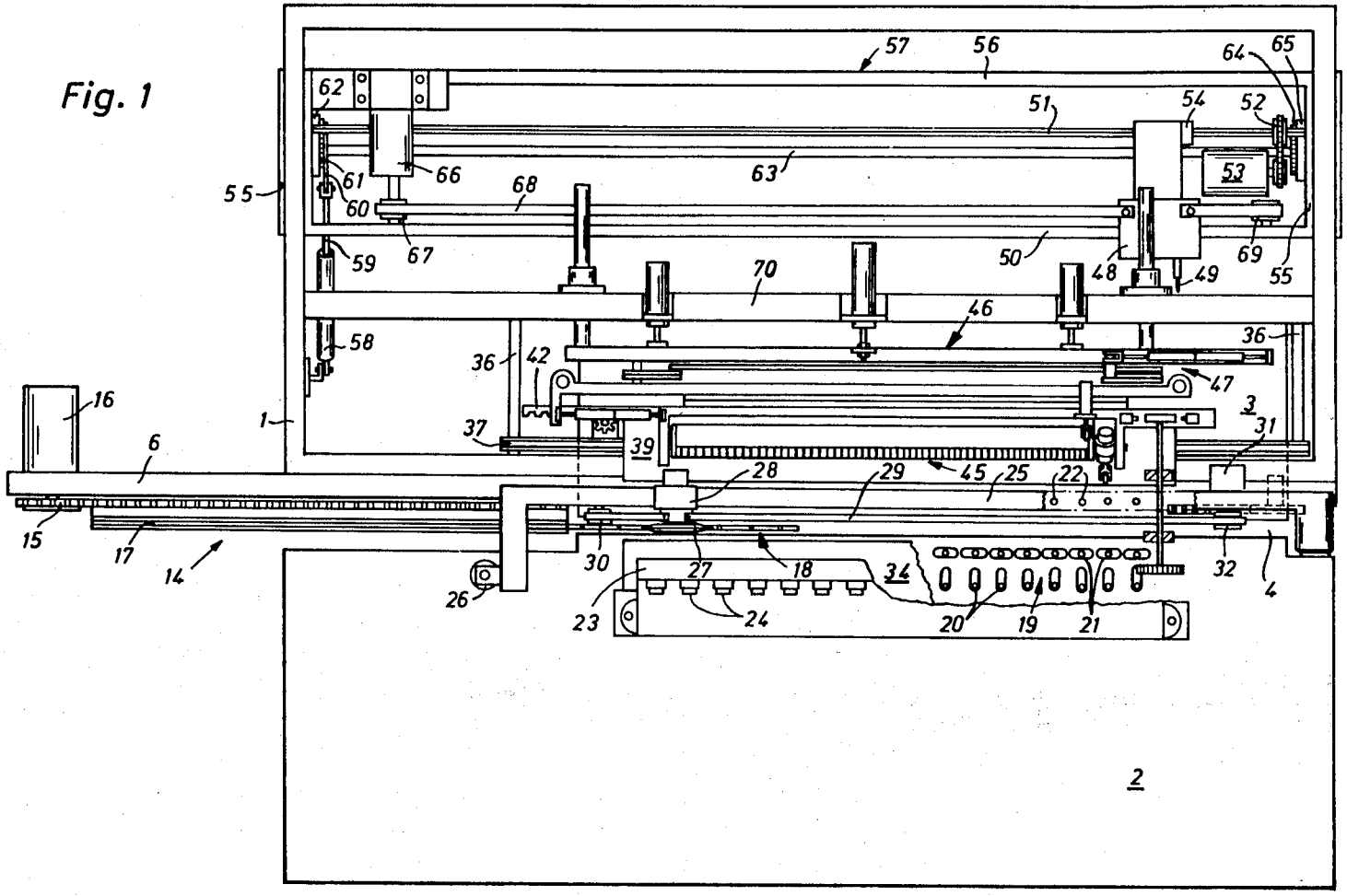
FIG. 1 is a top plan view of the letting-out equipment according to the invention.

Referring to the drawings in particular, the invention embodied therein comprises a device for letting out a hide to be tucked and sewn at seams extending in the longitudinal direction, with the leading edge of the hide extending at an angle to the longitudinal direction, which includes clamping jaws, a parting sword for moving the hide up into the space between the clamping jaws, cutting and sewing devices for cutting and sewing the hide in the seam area and a seam gripper for gripping the sewn seam and repositioning the hide for the production of additional sewn seams in the hide.

Figure 2:
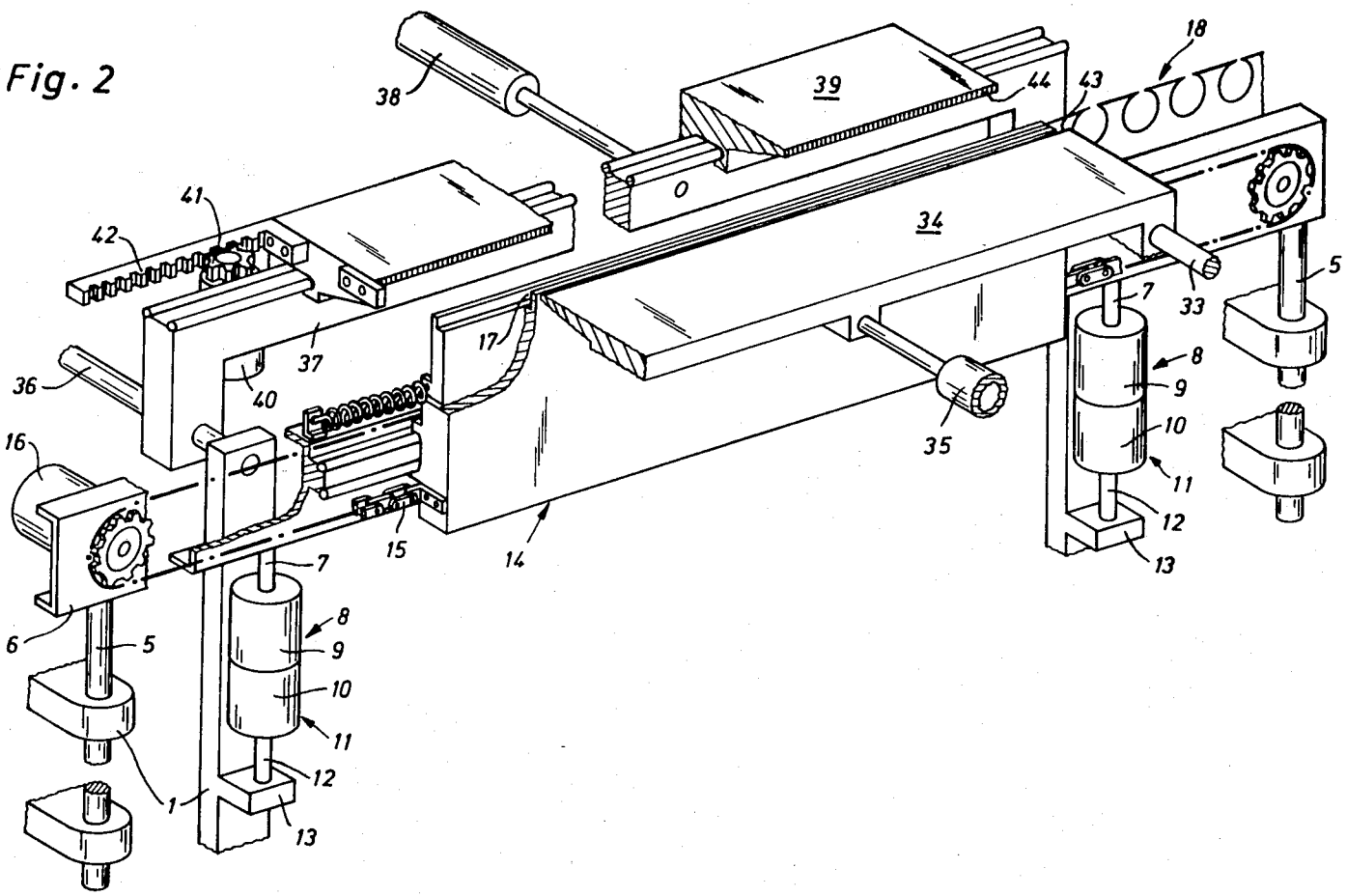
FIG. 2 is a diagrammatic perspective representation of the parting sword and of the clamping jaws.

A horizontal front table panel 2 and a rear table panel 3 are arranged on a frame 1. The rear panel 3 is in part, inclined downwardly (FIG. 5). The two table panels 2, 3 are separated by a slit 4. On two vertical guide rods 5 (FIG. 2) secured on frame 1, a horizontal beam 6 which is parallel to slit 4, is arranged. Beam 6 is supported on the piston rods 7 of two compressed air cylinders 8 on the housing 10 of an additional serially connected compressed air cylinder 11, the piston rod 12 of which takes support on a shoulder 13 secured on frame 1. With the two pairs of serially connected air cylinders 8, 11, the beam 6 can be moved into three different height positions.

A longitudinally displaceable parting sword 14 is mounted on beam 6, which, via a chain 15, is in driving connection with a brake motor 16 fastened on beam 6. The parting sword 14 is provided at its top with a longitudinal groove 17 and carries at its front end a comb-like hide hair divider 18 parallel to it.

A holding device 19, for the hides which are placed on the table panels 2, 3, is provided on both sides of slit 4 (FIG. 1). Device 19 consists of needle rows 20, 21 and 22, two of which are provided under the front panel 2 and an additional one under the rear panel 3 (FIG. 5). The needle rows 20, 21, 22 can be moved up and down and protrude in the raised position through corresponding openings not marked in the table panels 2 and 3, beyond the tops thereof.

Correlated with the parting sword 14 is an elongated hold-down 23 extending parallel to the parting sword (FIG. 1), which can be moved by means (not shown) from the raised position shown in FIG. 1 (set back crosswise relative to slit 4) toward the parting sword 14 and can at the same time be lowered. On the hold-down 23, several compressed air connections 24 are arranged, which are connected with a plurality of downwardly directed compressed air nozzles (not shown).

A guide rod 25 (FIG. 1) is pivotably mounted on frame 1, which swings up and down by means of a compressed air cylinder 26 arranged on frame 1 in a manner not explained in detail. On the guide rod 25, a cutting device 28 equipped with a circular knife 27 is slidably mounted. The cutting edge of knife 27 lies in a vertical plane passing through the longitudinal groove 17 of the parting sword 14. The cutting device 28 is firmly connected with a toothed belt 29, which runs over a guide wheel 30 mounted on the guide rod 25 and over a drive wheel 32 connected to a motor 31.

A horizontal front clamping jaw 34 is mounted for sliding motion on fixed slide-rods 31 (FIG. 2) above the front table panel 2. Front clamping jaw 34 can be moved forwardly and backwardly by a compressed air cylinder 35, in a direction which is crosswise to the longitudinal axis of the parting sword 14. Above the rear table panel 3, a horizontal beam 37 is slidably mounted on fixed slide rods 36, which beam can be moved forwardly and backwardly by a compressed air cylinder 38, also in a direction which is crosswise to the longitudinal axis of the parting sword 14. A rear clamping jaw 39 which is parallel to the parting sword 14, is arranged on beam 37. A step motor 40 is fastened on beam 37, which drives a pinion 41. Pinion 41 meshes with a rack 42 fastened to the rear clamping jaw 39. The jaws 34, 39 are cuneiform or wedge shaped on the sides facing each other and form narrow toothed clamping areas 43, 44.

A feed device 46 provided with a gripping tool 45 serves to advance the hides. The drive mechanism of the gripping tool 45 is marked 47.

A sewing machine 48 (FIG. 1) for sewing the hide parts together has a needle 49 moving back and forth in a horizontal plane. The sewing machine 48 is displaceably mounted on a guide rod 50 parallel to the parting sword 14 in a horizontal plane and on a serrated shaft 51 which is parallel to the guide rod 50. The serrated shaft 51 is connected to a brake motor 53 via a chain drive 52 and drives, via a cam wheel 54 with internal serration, the mechanism (not shown) of the sewing machine 48. The guide rod 50 and the serrated shaft 51 are arranged on two slides 55 which are mounted on frame 1 and are movable crosswise to the parting sword and toward the parting sword 14. The slides 55 are connected together by a fixed rod 56 and form with it a frame 57. To move the frame 57 a compressed air cylinder 58 is used, whose piston rod 59 drives a gear 61 via a lever 60. Gear 61 meshes with a rack 62 fastened on frame 57. The gear 61 is connected through a torsion-proof shaft 63 with another gear 64, which meshes with a second rack 65 also fastened on frame 57. A step motor 66 is secured on frame 57 and drives a toothed belt 68 via a drive wheel 67. Belt 68 runs over a guide wheel 69 mounted on frame 57 and is firmly connected with the sewing machine 48.

Two guide rods 72 are displaceable crosswise to the parting sword 14 in two bearing bushings 71 (FIG. 3) secured to a longitudinal strut 70 of frame 1. These rods carry, on their end toward the sword 14, a support plate 73. An air cylinder 74 is fastened on strut 70, and has a piston rod 75 which is firmly connected to the support plate 73. Further, two air cylinders 76 are fastened to strut 70, and have piston rods 77 each carrying a strike plate 78. The piston rod 80 of an air cylinder 81 is disposed on a bracket 79 which is fastened to support plate 73. The housing 82 of this air cylinder 81 is firmly connected to the housing 83 of a second air cylinder 84 serially connected with the first. The piston rod 85 of the second air cylinder 84 is hinged to a two-armed lever 86. Lever 86 is mounted on a bolt 87 fastened in support plate 73. The lower end of lever 86 is connected to a link 88 carrying a bolt 89. At the lower end of lever 86 there is further hinged a connecting rod 90 which is connected to two links 91, 92. The upper link 91 is mounted on a bolt 93 fastened to support plate 73. The lower link 92 carries a bolt 94.

The bolts 89 and 94 protrude into corresponding bores 95 of a guide plate 96. Two vertical guide rods 98 are fastened in two shoulders 97 of the guide plate 96. Rods 98 are displaceable in brackets 99 which are fastened on frame 1 A slide 101 is arranged on a horizontal track 100 of guide plate 96 which is displaceable parallel to the parting sword 14 and hence in the lengthwise direction thereof. Piston rod 102 of an air cylinder 103 is fastened on slide 101. The housing 104 of this cylinder 103 is firmly connected to the housing 105 of a second cylinder 106 serially connected with the first. The piston rod 107 of the second air cylinder 106 is fastened to a bent arm 108 of guide plate 96. Two crosswise extending side cheeks 109 are formed on slide 101. On slide 101 are fastened spaced from each other two angle pieces 110 (FIG. 3) and fastened to slide 101. Each angle piece 110 carries a mount 111 for a pin type strike piece 112. A shaft 114 is mounted on two arms 113 of frame 1 at one end of which is a cam plate 115 lying between the strike pieces 112, and at the other end of which is a setting wheel 116. The setting wheel 116 carries a scale 117.

Figure 4:
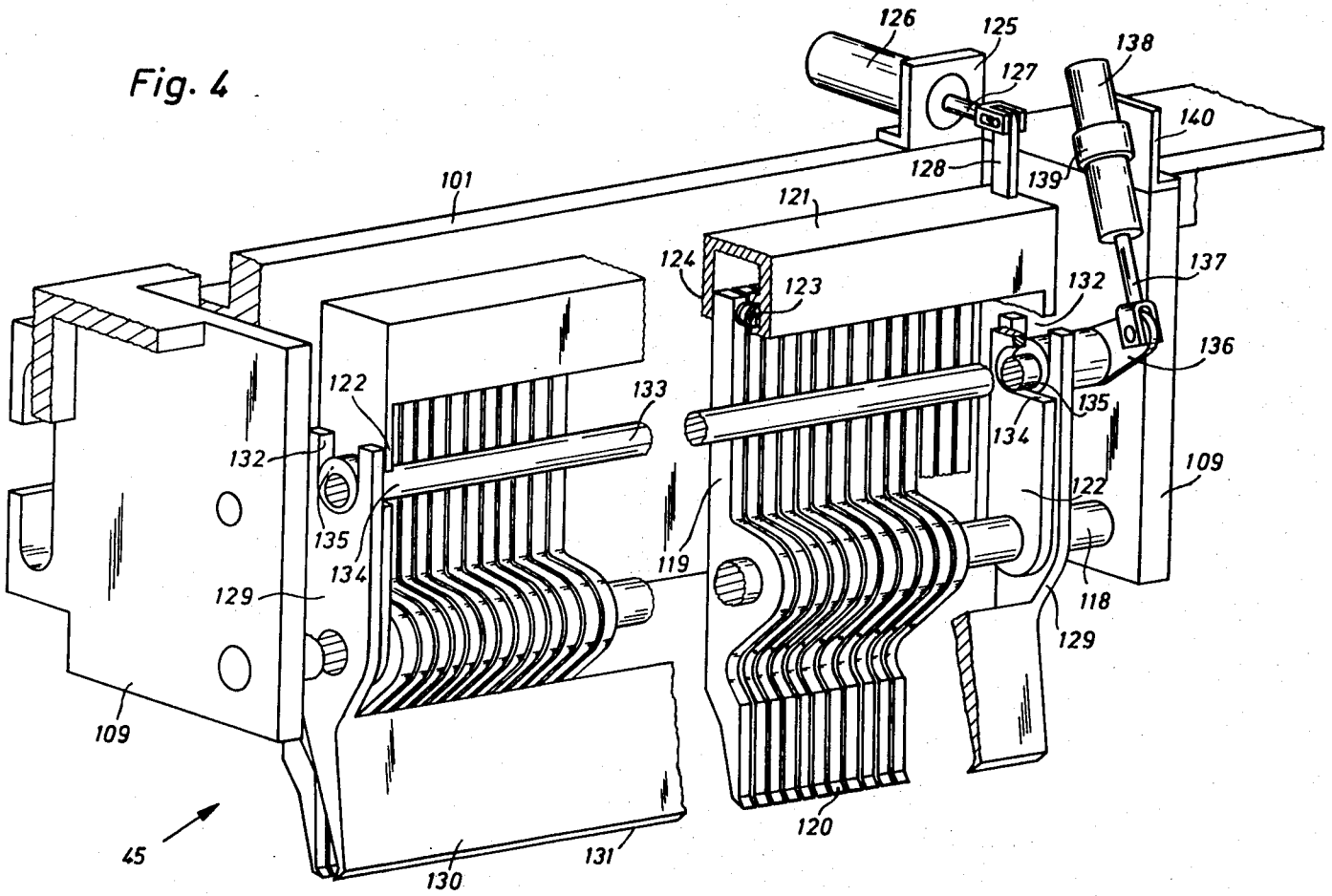
FIG. 4 is a diagrammatic perspective representation of the gripping tool.

A rod 118 (FIG. 4) is connected across side cheeks 109, bridging their mutual distance and extending parallel to the parting sword 14. A plurality of two-armed levers 119 are pivotally mounted on rod 118. The lower end of the levers 119 is wedge-shaped. The wedge-shaped ends form one jaw 120 of the gripping tool 45. The upper end of the levers 119 extends into a box type frame 121 which is pivotably mounted with downwardly extended lateral walls 122 on the rod 118. A compression spring 123 for each lever 119 is arranged in frame 121. The springs 123 push the upper ends of the levers 119 against the back wall 124 of frame 121. On an angle piece 125 fastened on slide 101, a compressed air cylinder 126 is arranged, whose piston rod 127 is hinged to an arm 128 fastened on frame 121.

Two arms 129 which are also pivotally mounted to rod 118 and are connected together by a plate 130 extending parallel to the parting sword 14. Plate 130 is cuneiform at its lower end. It forms the second jaw 131 of the gripping tool 45. The arms 129 are prolonged beyond rod 118 and are forked due to an opening 132 at their upper ends. In the side cheeks 109 a shaft 133 is mounted, which is passed through the openings 132 of the arms 129 and through corresponding openings 134 in the sidewalls 122. On shaft 133, in the region of the openings 132, two eccentrics 135 are fastened, whose diameter is fitted to the width of the openings 132. An arm 136 is fastened to shaft 133, to which the piston rod 137 of a compressed air cylinder 138 is articulated. Cylinder 138 is received in a mount 139, which is pivotably mounted on an angle piece 140 fastened on slide 101.

The equipment operates as follows:

The hide F to be let out is placed, hair side down, on the table panels 2, 3, the longitudinal edge L of hide F turned toward the inoperative sewing machine 48. (FIG. 13) and being aligned at an acute angle referred to as the cutting angle $\alpha$ to the cutting line S of the cutting device 28. Then, according to FIG. 5, the needle rows 20 and 22 are moved up, whereby the hide is fixed on the table panels 2, 3. Thereafter the hold-down 23 is lowered onto the hide, and the parting sword 14 with the hide hair divider 18 is moved by the brake motor 16 from the inoperative position shown in FIG. 1 into the operative position, in which the front section of the hide hair divider 18 is under the hide. Then the two air cylinders 8 are pressurized, whereby the beam 6 with the parting sword 14 and the hide divider 18 is lifted. At the end of this lifting stop, the hide hair divider 18 applies against the blade. By briefly rotating the brake motor 16 forwardly and backwardly several times, the hide hair divider 18 is moved reciprocally in the lengthwise direction, whereby it forms a parting furrow in the hide. Thereafter the parting sord 14 is pushed by the brake motor 14 into the parting furrow drawn by the hide hair divider 18, whereupon the sword occupies the position shown in FIG. 5.

As soon as the parting sword 14 is in the parting furrow, the two compressed air cylinders 11 are pressurized, whereby the beam 6 is raised still more. In so doing, the parting sword 14 lifts the hide with the formation of a fold, to the level of the clamping areas 43, 44 of the clamping jaws 34, 39. Then the two jaws 34, 39 are moved toward each other by the air cylinders 35, 38, clamping the hide between themselves and the parting sword 14 according to FIG. 6. So that at the beginning and end of a hide, the hide sections lying before and behind the parting furrow are pulled up evenly between the jaws 34, 39, the front needle row 20 is moved by a mechanism (not shwn) coupled with beam 6 by the amount of the lift movement of the parting sword 14 in the direction of the slit 4. Then the hold-down 23 is moved away. Thereafter the guide rod 25 is lowered and the hide is cut through with the cutting device 28 (FIG. 7).

After the guide rod 25 has been swung up, the back-spacing is carried out, in that the rear clamping jaw 39 is moved by the step motor 40 parallel to the parting sword 14 and hence in the lengthwise direction thereof. Through the longitudinal movement of the rear clamping jaw 39 the rear hide portion is moved along the parting sword 14 while being offset laterally relative to the front hide portion. Thereafter the parting sword 14 is lowered below the table panels 2, 3, whereupon the step motor 66 brings the sewing machine 48 from the inoperative position to the hide. As soon as the needle 49 of the sewing machine 48 reaches the longitudinal edge L of the set-back hide portion, the sewing machine 48 is turned on, whereupon the two hide portions are sewed together again (FIG. 8).

After the sewing operation, the support plate 73 and the guide plate 96 arranged on it together with the slide 101 and the gripping tool 45 is moved by the compressed air cylinder 74 (FIG. 3) from the inoeperative position, in the direction of the parting sword 14, until the open jaws 120, 131 are above the seam N. The guide plate 96 with the slide 101 is then lowered by the air cylinder 81 and the gear elements 83 to 94 until the bottom edges of the jaws 120, 131 are at the level of seam N. Thereafter the jaws 120, 131 are moved toward each other by the two air cylinders 126, 138, and the cut edge above seam N is clamped between the jaws 120, 131 (FIG. 9).

As soon as the gripping tool 45 has seized the cut edge, the two clamping jaws 34, 39 are again moved apart by the air cylinders 35, 38. Then the two compressed air cylinders 76 are pressurized, whereby the piston rods 77 with the strike plates 78 are moved in the direction of the parting sword 14. At the same time, by the compressed air cylinder 84 (FIG. 3) and the gear elements 85 to 94, the guide plate 96 with slide 101 is lowered still more, until the gripping tool 45 is just above the top of the table panels 2, 3. In so doing, the fold formed in the hide after the parting is flattened. Then the air cylinder 74 is pressurized oppositely, whereby it moves the support plate 73 with the guide plate 96, the slide 101 and the gripping tool 45 away from the parting sword 14, until the support plate 73 strikes against the strike plates 78. During this movement of the closed gripping tool 45, the hide is shifted crosswise to the lengthwise direction of the parting sword 14 and hence also crosswise to the seam N (FIG. 10 and 13). The position of the strike plates 78 determines the amount of transverse movement of the gripping tool 45 and hence of the transverse feed of the hide or respectively the distance $\alpha$ between two cuts or two seams N.

During the transverse movement of the gripping tool 45, the front needle row 20 is moved along in synchronism with the gripping tool 45 by a mechanism (not shown), coupled with the drive mechanism 47 of the gripping tool 45. Since, due to the oblique position of the hide, the hide's transverse movement takes place obliquely, not parallelly, to the lengthwise direction thereof, it is achieved by the moving along of the needle row 20 that even in the case of long hides the rear end thereof moves along in the transverse direction also and does not migrate out of the oblique position due to the frictional resistance between the table panel 2 and the hide (from solid to the broken line for the hide in FIG. 13).

Figure 3:
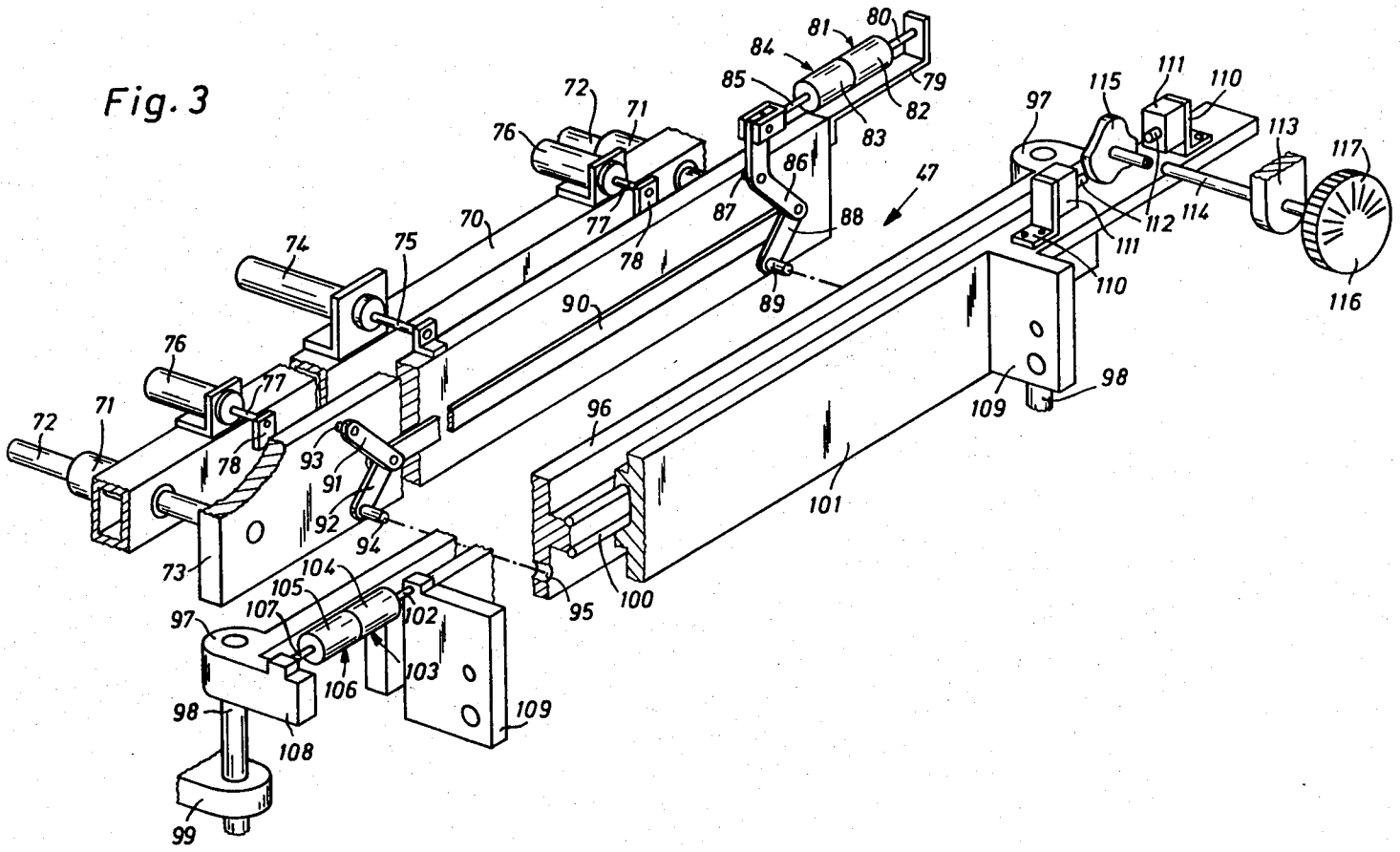
FIG. 3 is a diagrammatic perspective representation of the drive mechanism of the gripping seal.

After the transverse movement of the gripping tool 45, the slide 101 with the still closed gripping tool 45 is moved by the air cylinder 103 parallel to the lengthwise direction of the parting sword 14, until in FIG. 3 the left strike piece 112 strikes against the cam plate 115. During this longitudinal movement called also return movement, the hide is displaced parallel to its cuts or seams N by the measure b (FIG. 13). The measure b corresponds to the length of the adjacent side of the triangle formed by the cutting angle $\alpha$ and the distance a between two cuts or seams N. By this longitudinal movement of the hide the distance between the inoperative sewing machine 48 and the starting edge of each seam N is kept constant. The amount of longitudinal movement of the gripping tool 45 required at each cutting angle is maintained by setting the cam plate 115 to the cutting angle $\alpha$ indicated on the scale 117 of the setting wheel 116.

During the longitudinal movement of the gripping tool 45, the front and rear needle rows 20, 22 are lowered. The central needle row 21, on the contrary, is moved along in synchronism with the gripping tool 45 by a mechanism (not shown) coupled with the drive mechanism 47 of the gripping tool 45. In this way it is achieved that in particular in the case of long hides their rear end is pulled along longitudinally in the same amount (FIG. 11).

After termination of the longitudinal movement, the gripping tool 45 stands still in the position it has assumed. It remains closed, so that it continues to grip the hide by the cut edge. Since after the first letting out operation the hide is held in the region of the rear table panel 3 by the gripping tool 45, it now suffices to lift the front needle row 20 in order to retain the hide on both sides of slit 4 during the next parting operation (FIG. 12).

While a specific embodiment of the invention has been shown and described in detail to illustrate the application of the principles of the invention, it will be understood that the invention may be embodied otherwise without departing from such principles.

What is claimed is:

1. A device for letting out a hide to be cut and sewn at seam areas extending in a longitudinal direction and at an angle to an edge of the hide, comprising:

a pair of clamping jaws for clamping the hide at each seam area;

jaw drive means for moving the jaws laterally of the longitudinal direction to clamp the hide at each seam area;

a parting sword movable between the jaws and extending in a longitudinal direction, said parting sword including a hide hair divider for parting hair on the hide to form a furrow therein;

sword drive means connected to said printing sword for moving said sword in the longitudinal direction to form the furrow and upwardly to push the hide at each seam area between said jaws;

cutting means for cutting the seam area after it is clamped by said clamping jaws;

backspacing means connected to at least one of said jaws for moving said jaws with respect to each other for a first selected amount in the longitudinal direction;

a sewing machine for sewing the seam area after said jaws are moved by said backspacing means and the seam is cut by said cutting means;

a seam gripper for gripping the seam after it is sewn by said sewing machine and moving the seam downwardly of said clamping jaws and laterally of said longitudinal direction by a second selected amount corresponding to a distance between adjacent seam areas on the hide; and gripper drive means for moving said seam gripper downwardly and transversely of the longitudinal direction for repositioning the hide to bring an additional seam area thereof into alignment with said parting sword.

2. A device according to claim 1, wherein said gripper drive means moves said gripper by said second selected amount which corresponds to one side of a right triangle having an opposite angle corresponding to said angle between said longitudinal direction and the hide edge, and a second side adjacent said angle corresponding to said first selected amount by which the hide is offset in each seam area, said backspacing means operable to move one of said pair of jaws in said longitudinal direction with respect to the other of said pair of clamping jaws by said second selected amount, whereby said sewing machine begins the sewing of each new seam area at the same starting direction.

3. A device according to claim 2, including adjustable cam means connected to said seam gripper for stopping said gripper drive means after said gripper drive means has moved said seam gripper by said second selected amount.

4. A device according to claim 3, including a frame, said seam gripper including a gripper plate movable in said longitudinal direction with respect to said frame, a cam shaft connected to said frame having a cam at one end thereof and a cam set wheel at an opposite end thereof, and a pair of stops connected to said gripper plate for establishing the end position of movement for said gripper plate in said longitudinal direction.

5. In equipment for letting out hides having a holding device for the hide, two clamping jaws cooperating like pliers and movable relatively to each other in a longitudinal direction, a parting sword arranged between the jaws with a forwardly positioned hide hair divider, a cutting device for cutting the hide and a sewing machine for sewing the cut edges of the hide, an improvement characterized by the arrangement of a gripping tool which grips the hide by the cut edges, and means for moving the tool up and down and displacing the tool in a horizontal plane crosswise to the parting sword.

6. In equipment according to claim 5, the improvement characterized in that to obtain a constant distance between the sewing machine and a seam start on the hide, the gripping tool is movable according to the length of the adjacent side of the right-handed triangle formed by a cutting angle and a distance between cuts, parallel to the parting sword.

7. In equipment according to claim 6, the improvement characterized in that the length of the movement of the gripping tool parallel to the parting sword is limited by an adjustable cam plate.

8. In equipment according to claim 7, the improvement characterized in that the cam plate is provided with a scale representing various cutting angles.

9. A method of letting out a hide to be cut and sewn at a plurality of equally spaced seam areas comprising:

placing the hide hair side down on a table having a slit therein extending in a longitudinal direction parallel to the seam areas to be cut and sewn;

passing a parting sword through said slit and into contact with the hide for parting hairs of the hide in the vicinity of the slit and forming a furrow in the hide hairs;

providing a pair of clamping jaws over the hide having a space therebetween aligned with the slit;

pushing the hide upwardly through the space between the jaws to form a seam area;

moving the jaws together to clamp the hide in the seam area;

cutting the hide in the seam area;

backspacing one of said jaws with respect to the other in the longitudinal direction to offset the cut hide in the seam area thereafter sewing the hide in the seam area;

gripping the hide at the sewn seam area;

moving the jaws apart to unclamp the seam area;

moving the gripped seam area downwardly and laterally of said slit in a direction transverse to said longitudinal direction by an amount corresponding to the equal space between seam areas; and using the parting sword to produce an additional furrow in the hide in an additional seam area.

10. A method according to claim 9, wherein the hide is elongated and has an elongated edge, said slit extending in said longitudinal direction being at an acute angle to the hide edge, said method including backspacing one of said jaws with respect to the other in said longitudinal direction to offset said hide in the seam area by a second amount, said first mentioned and second amounts forming the short sides of a right triangle having said acute angle as one angle thereof, whereby said sewing step is initiated for each seam area at a common position.

* * * * *